US007926232B2

(12) United States Patent
de Raucourt

(10) Patent No.: US 7,926,232 B2
(45) Date of Patent: Apr. 19, 2011

(54) INSTALLATION BRACKET AND SYSTEM FOR CROWN MOLDING

(76) Inventor: Jean-Claude de Raucourt, Toronto (CA)

( * ) Notice: Subject to any disclaimer, the term of this patent is extended or adjusted under 35 U.S.C. 154(b) by 454 days.

(21) Appl. No.: 12/010,390

(22) Filed: Jan. 24, 2008

(65) Prior Publication Data

US 2008/0172964 A1 Jul. 24, 2008

Related U.S. Application Data

(60) Provisional application No. 60/897,064, filed on Jan. 24, 2007.

(51) Int. Cl.
*E04B 2/00* (2006.01)

(52) U.S. Cl. ..... 52/288.1; 52/287.1; 52/290; 52/717.06; 52/718.03

(58) Field of Classification Search ..... 52/288.1, 52/281, 287.1, 290, 716.4, 716.7, 718.03, 52/717.06, 716.1
See application file for complete search history.

(56) References Cited

U.S. PATENT DOCUMENTS 5,179,811 A * 1/1993 Walker et al. ..... 52/288.1
6,385,939 B1 * 5/2002 Stout ..... 52/718.01
6,911,597 B2 * 6/2005 Seamans et al. ..... 174/507
2002/0046537 A1 * 4/2002 Benedettini ..... 52/716.1
2004/0250500 A1 * 12/2004 Lam ..... 52/716.1
2005/0155312 A1 * 7/2005 Friday ..... 52/716.1
2006/0156679 A1 * 7/2006 Pierret ..... 52/698
2006/0196144 A1 * 9/2006 Spek ..... 52/720.1

* cited by examiner

*Primary Examiner* — Basil Katcheves
*Assistant Examiner* — Branon C Painter
(74) *Attorney, Agent, or Firm* — Dowell & Dowell, P.C.

(57) ABSTRACT

An installation bracket system for use in combination with a length of crown molding for securing the crown molding adjacent to the junction of a wall surface and a ceiling surface, the installation bracket system including one or more installation brackets, each of the one or more installation brackets having first support member and a second support member, each of the support members having a mounting portion and an integrally formed supporting portion, the mounting portion having a base formed with apertures to receive fasteners therethrough for securement of the first support member and the second support member to the wall surface and ceiling surface, respectively, and a backing member extending between the first support member and the second support member, the backing member having a front surface, the crown molding being secured against the front surface of the backing member.

18 Claims, 4 Drawing Sheets

INSTALLATION BRACKET AND SYSTEM FOR CROWN MOLDING

FIELD OF THE INVENTION

The present invention relates to an installation bracket for crown molding. The present invention further relates to an installation bracket system for facilitating the installation of crown molding along a junction between a wall surface and a ceiling surface.

BACKGROUND OF THE INVENTION

Crown molding is a decorative material commonly installed in commercial and residential buildings for aesthetic purposes. Crown molding has also been used for functional purposes, such as for concealing exposed pipes or wires when renovating an existing commercial or residential building. The installation of a length of crown molding along the junction of wall and ceiling surfaces requires a considerable amount of expertise and patience, especially when minute adjustments to the positioning of the crown molding are required to properly install the molding along the wall and ceiling surfaces.

In commercial and residential buildings constructed with concrete wall and/or ceiling surfaces, the installation of crown molding requires the use of concrete screws (such as Tapcon® screws). In order to accommodate the concrete screws, the installer must pre-drill holes in the concrete wall and/or ceiling surface before positioning and fastening the crown molding. Once fastened to the surface using the concrete screws, the positioning of the crown molding cannot be adjusted by the installer without unfastening the entire length of crown molding from the wall and ceiling surfaces and pre-drilling new holes in the desired location in the concrete wall. If the holes in the surface of the crown molding align with the new holes in the wall and ceiling surfaces, the length of crown molding may be resecured to the wall and ceiling surfaces. Otherwise, new holes must be pre-drilled in the crown molding to enable the reinstallation of the crown molding. Given the larger diameter of most crown molding fasteners, including concrete and dry wall screws, the decorative face of the crown molding commonly becomes marred as a result of the fastening and unfastening of the plurality of fasteners along the length of the crown molding. These holes in the front face of the crown molding become increasingly larger every time the crown molding must be uninstalled and refastened to the surface during the conventional installation and adjustment process. Once installed, the installer must painstakingly repair the crown molding using a filler material and sandpaper to create a uniform and aesthetically pleasing appearance along the front surface of the crown molding. The present invention overcomes these problems and disadvantages in the prior art crown molding installation techniques.

Accordingly, it is an object of the present invention to provide a system of installation brackets for facilitating the installation of lengths of crown molding along the junction of a wall surface and a ceiling surface in commercial and residential applications.

SUMMARY OF THE INVENTION

The present invention is directed to an installation bracket system for use in combination with a length of crown molding for securing the crown molding adjacent to the junction of a wall surface and a ceiling surface, the installation bracket system comprising one or more installation brackets, each of the one or more installation brackets having a first support member and a second support member, each of the support members having a mounting portion and an integrally formed supporting portion, the mounting portion having a base formed with apertures to receive fasteners therethrough for securement of the first support member and the second support member to the wall surface and the ceiling surface, respectively, and a backing member extending between the first support member and the second support member, the backing member having a front surface, the crown molding being secured against the front surface of the backing member.

Each of the pair of support members comprising a single flat metal piece punched and bent to form the mounting portion and the supporting portion. The supporting portion extends from the mounting portion along an inclined plane. The supporting portion comprising a C-shaped channel for receiving and supporting at least a portion of the backing member, the channel having a bottom wall, a pair of opposing side walls and a pair of top flanges extending from the opposing side walls.

The backing member having a first end and a second end, wherein the supporting portion of the first support member receiving and supporting the first end of the backing member, and wherein the supporting portion of the second support member receiving and supporting the second end of the backing member.

In an embodiment of the present invention, the base of the mounting portion of each of the first and second support members formed with one or more positioning portions for releasably securing the support members to the wall and ceiling surfaces, respectively, each of the positioning portions having a positioning slot and an integrally formed positioning tooth formed from the material separated from the base during the formation of the positioning slot. The positioning tooth having a curved and tapered end for insertion partially through the positioning slot and into either of the wall and ceiling surfaces.

In a further embodiment of the present invention, the bottom wall of the supporting portion each of the first and second support members formed with one or more retaining portions for releasably securing the backing members within the channels, each of the retaining portions having a retaining slot and an integrally formed retaining tooth formed from the material separated from the bottom wall during the formation of the retaining slot. The retaining tooth having a curved and tapered end for insertion partially through the retaining slot and into the backing member.

In a further embodiment of the present invention, the backing member has a front surface and a back surface, each of the front and back surfaces formed with a plurality of segments defined by spaced apart segment lines, portions of the backing member being adaptable for snapping along the spaced apart segment lines to shorten the length of the back member.

BRIEF DESCRIPTION OF THE DRAWINGS

For a better understanding of the present invention, and to show more clearly how it may be carried into effect, reference will now be made, by way of example, to the accompanying drawings which show preferred embodiments of the present invention, and in which.

DETAILED DESCRIPTION OF THE INVENTION

Figure 1:
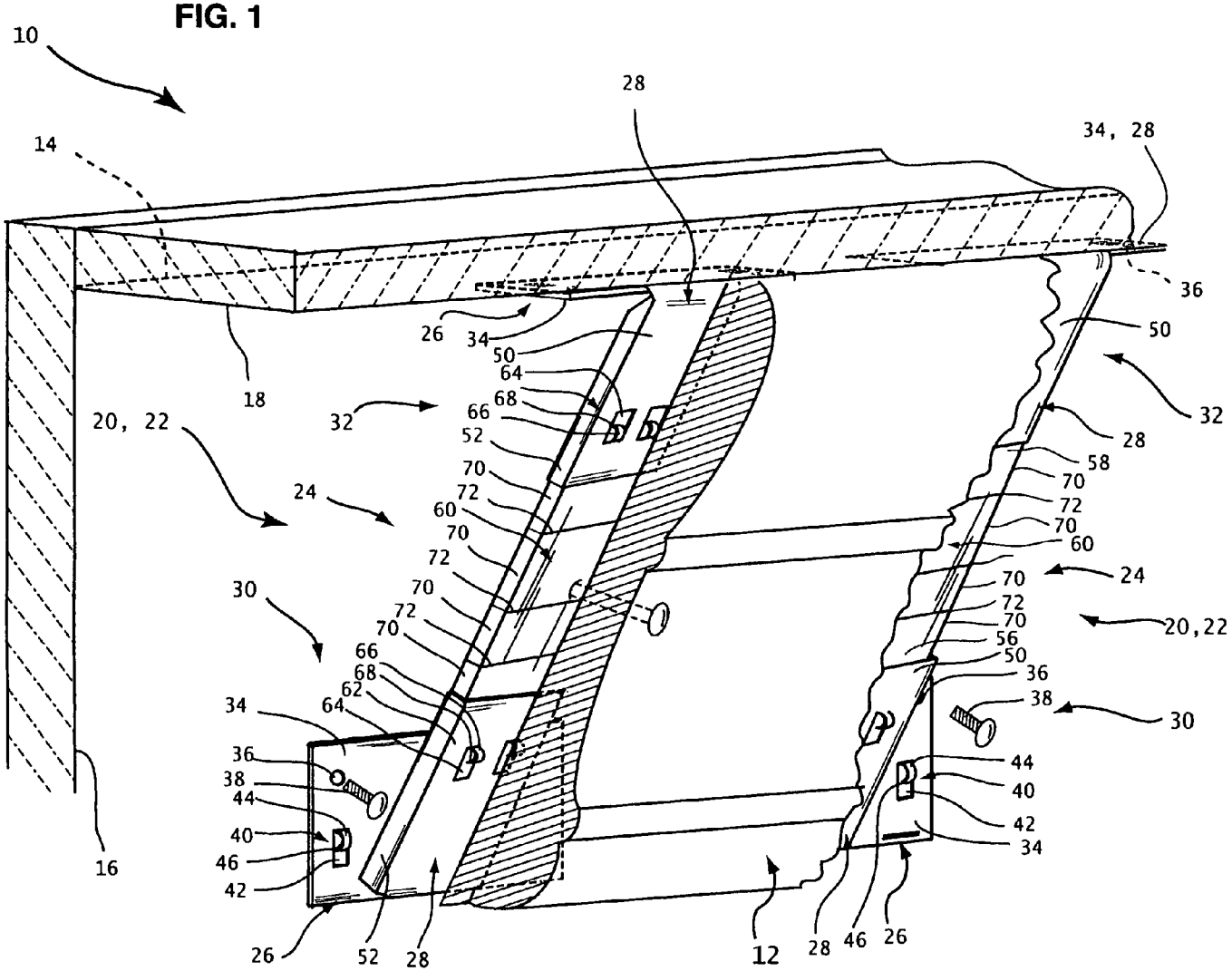
FIG. 1 is a perspective view of an installation bracket system in accordance with an embodiment of the present invention, supporting a length of crown molding along the junction of a wall surface and a ceiling surface.

Referring now to the drawings there is shown generally as reference number 10 an installation bracket system constructed in accordance with the present invention for securing a length of decorative crown molding 12 adjacent to a junction 14 between a wall surface 16 and a ceiling surface 18 to enhance the aesthetic appearance of the interior design of commercial and residential buildings. The installation bracket system 10 of the present invention is designed to facilitate the installation of crown molding 12 on a wide variety of wall and ceiling surfaces 16 and 18, including surfaces constructed from wood, steel, dry wall or form-poured concrete.

Figure 2:
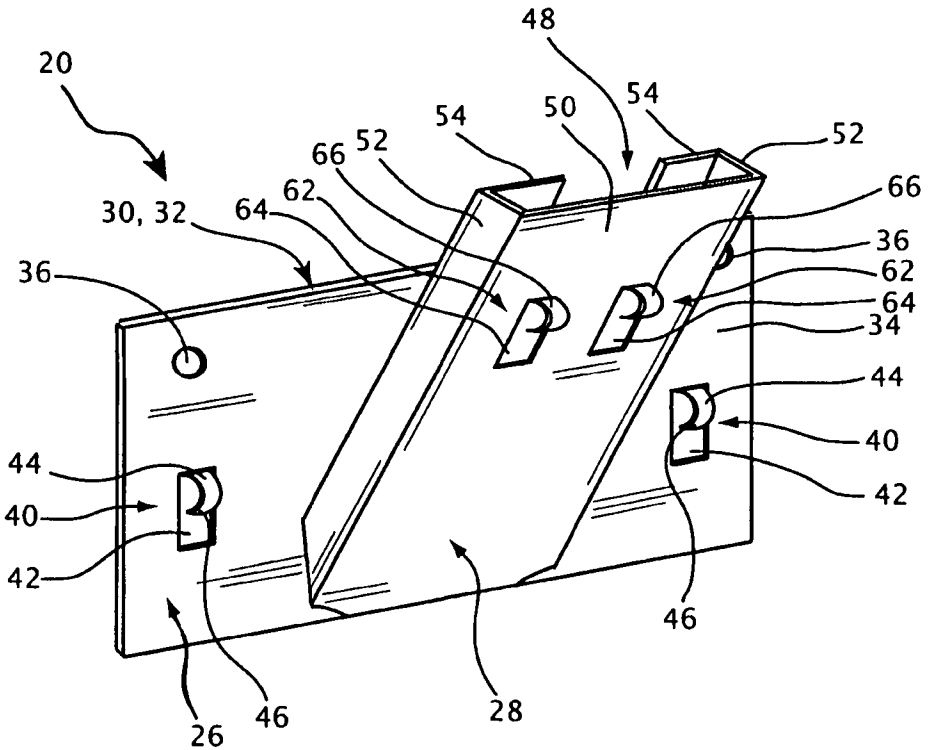
FIG. 2 is perspective view of the installation bracket shown in FIG. 1.

Referring to FIGS. 1 and 2, the installation bracket system 10 is comprised of one or more installation brackets 20 that are installed along the junction 14 for supporting the length of decorative crown molding 12. Each of the one or more installation brackets 20 consists of a pair of support members 22 and a backing member 24. The support members 22 are manufactured from a single sheet of metal, such as galvanized steel, which is punched and bent to form a mounting portion 26 and an integrally formed supporting portion 28. The pair of support members 22 consists of a first support member 30 that is secured to the wall surface 16 proximate to the junction 14 and a second support member 32 that is secured to the ceiling surface 18 proximate to the junction 14 and the first support member 30. The first and second support members 30 and 32 have identical configurations, and therefore the following description of the first support member 30 also describes and applies to the second support member 32. As it would be redundant to describe both the first and second support members 30 and 32 separately, the description of the second support member 32 has been omitted from the detailed description of the present invention for the sake of simplicity.

As shown in FIGS. 1 and 2, the mounting portion 26 of the support members 30, 32 has a generally rectangular shaped base 34 that is formed with a pair of base apertures 36, whereby the base apertures 36 receive fasteners 38 (shown in FIG. 1) for securing the support member 30, 32 on the wall surface 16 or ceiling surface 18. The base apertures 36 may be generally circular, and may be sized to permit easy pass-through of the fasteners 38. It should be understood by persons skilled in the art of the present invention that the fasteners 38 may be any suitable fasteners for securing the support members to the wall and ceiling surfaces 16, 18, such as, for example, Tapcon® screws, dry wall screws, nails or adhesive materials.

Figure 5:
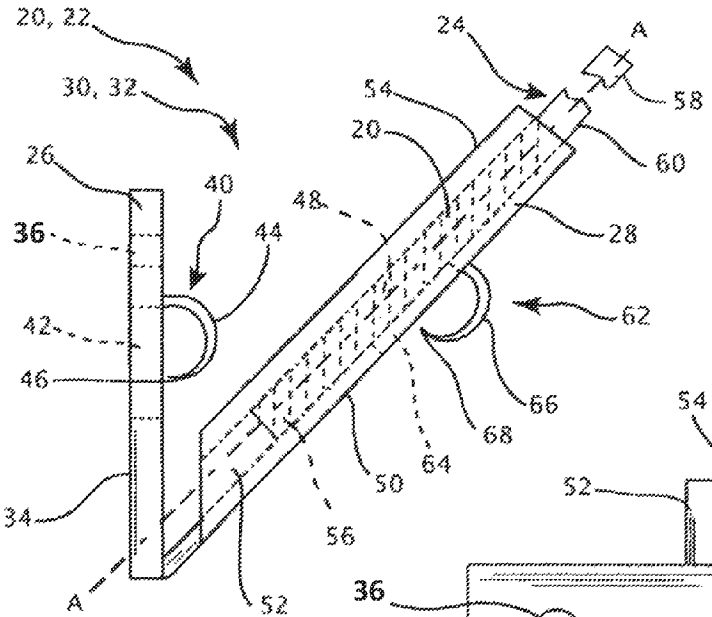
FIG. 5 is a plan view of the base of the mounting portion of the installation bracket shown in FIG. 2.

As is clearly shown in FIGS. 1, 2 and 5, the base 34 may be formed with one or more positioning portions 40 for enabling the support members 30, 32 to be releasably secured to the wall surface 16 or ceiling surface 18 when test fitting or adjusting the installation of the installation brackets 20 and crown molding 12. Each of the positioning portions 40 includes a positioning slot 42 formed in the base 34 and a positioning tooth 44 formed from the material separated from base 34 during the formation of the positioning slot 42. Each positioning tooth 44 has a tapered end 46 and is curved so that the tapered end 46 will be driven at least partially through the positioning slot 42 and into the wall surface 16 (or ceiling surface 18) when the support member 30, 32 is positioned against the wall surface 16 (or ceiling surface 18). Since the tapered end 46 of the positioning tooth 44 is tapered, the positioning tooth 44 can be readily inserted or hammered into a drywall sheet affixed to the wall surface 16 (or ceiling surface 18). The use of the positioning tooth 44 advantageously addresses the concern that occurs when an installer attempts to install a bracket, such as the installation bracket 20 of the present invention, while simultaneously holding a fastener 38 and drilling the fastener 38 into the wall surface 16 or ceiling surface 18. The positioning portion 40 of the present invention facilitates the alignment and repositioning of the support members 30, 32 on the wall and ceiling surfaces 16, 18 by the installer when test fitting the crown molding 12, if necessary.

Figure 4:
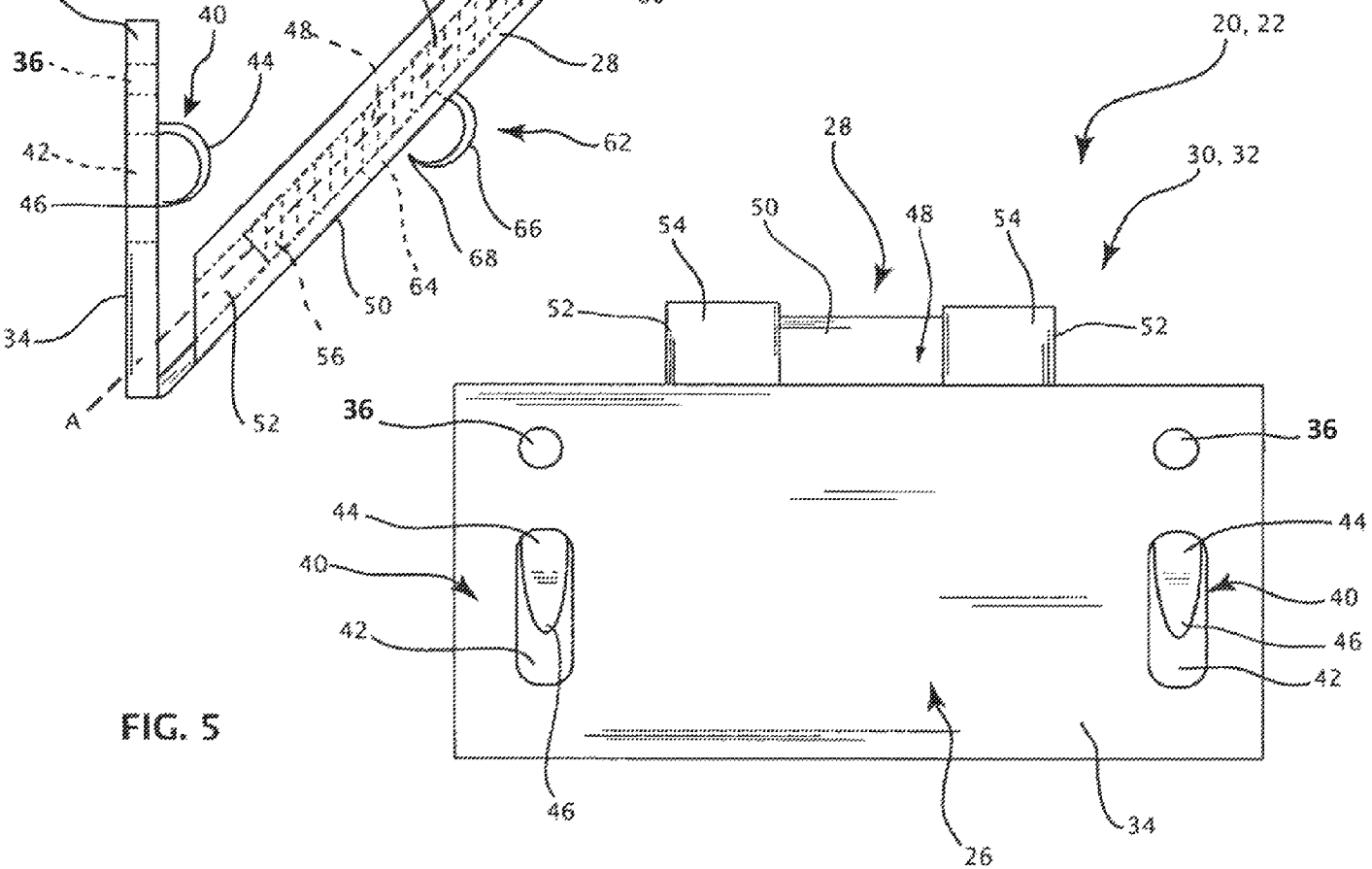
FIG. 4 is a side view of the support member of the installation bracket shown in FIG. 2.
Figure 6:
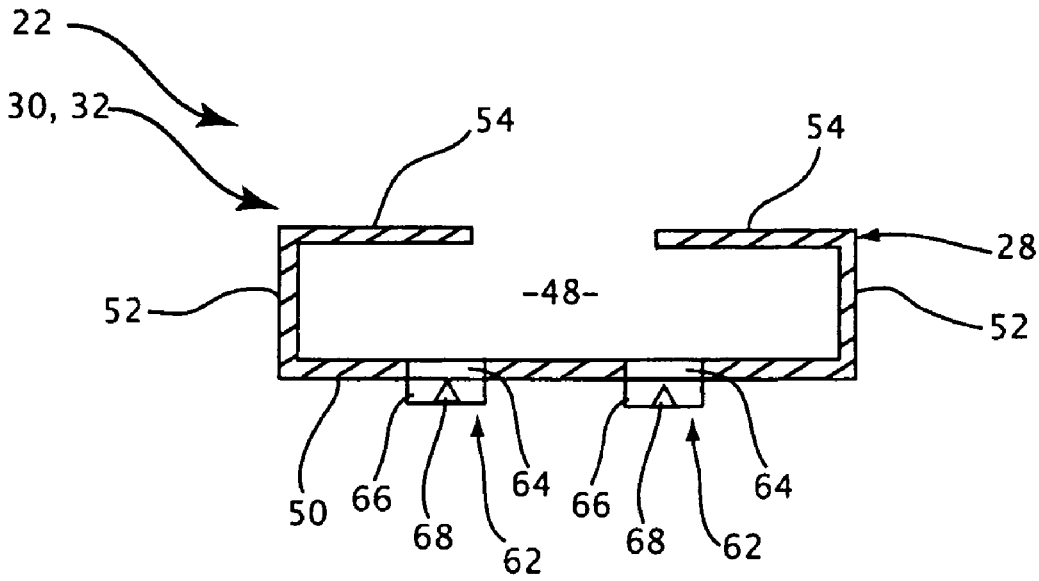
FIG. 6 is a cross-sectional view of the channel of the supporting portion of the installation bracket shown in FIG. 4 across axis A-A.

As shown in FIGS. 4 and 6, the supporting portion 28 is integrally formed with the mounting portion 26 and extends from the mounting portion 26 along an inclined plane denoted by the axis A-A (shown in FIG. 4) towards the complementary supporting member 30, 32. The supporting portion 28 is bent to form an upward facing C-shaped channel 48. The channel 48 has a bottom wall 50, two opposing side walls 52 and two top flanges 54. It should be understood that the dimensions of the mounting and support portions 26 and 28 may be adapted to conform to any suitable shape or configuration of the backing member 24 coupled to the support members 30, 32 so as to adequately support the weight of the crown molding 12. The dimensions of the mounting and supporting portions 26 and 28 and the backing member 24 can be determined based on the dimensions and weight of the crown molding 12 to be installed along the junction 14 of the wall and ceiling surfaces 16 and 18.

Figure 3:
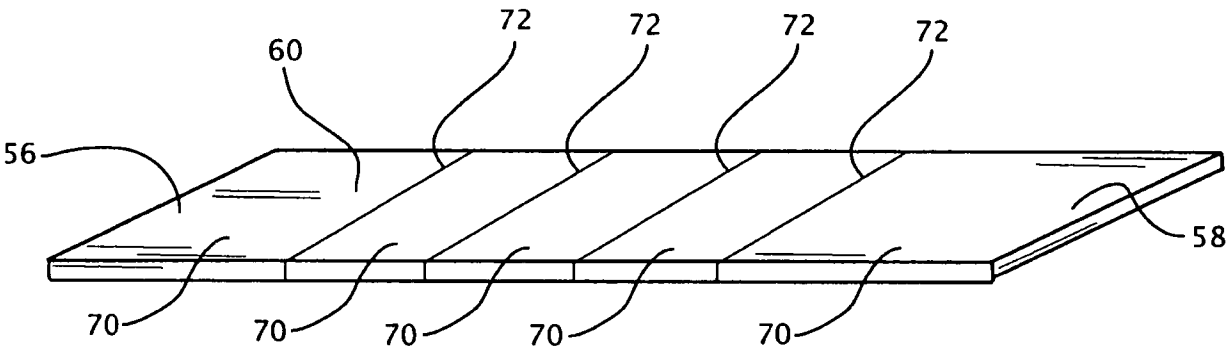
FIG. 3 is a perspective view of the backing member of the installation bracket.

As shown in FIG. 3, backing member 24 is generally rectangular shaped and has a first end 56 and a second end 58 disposed oppositely to the first end 56. During the installation of the installation bracket 20, the first end 56 of the backing member 24 is received within the channel 48 (shown in FIG. 4) formed in the supporting portion 28 of the first support member 30. Similarly, the second end 58 of the backing member 24 is received within the channel 48 formed in the supporting portion 28 of the complementary second support member 32. When the backing member 24 has been inserted into the corresponding channels 48 in the support members 30, 32 and the first and second support members 30 and 32 have been secured to the wall and ceiling surfaces 16 and 18, respectively, a front surface 60 of the backing member 24 extending between the first and second support members 30 and 32 provides a stable surface to which the crown molding 12 can be secured. Since the length of crown molding 12 is being secured to the backing member 24 of the installation bracket 20, and not directly to the wall and ceiling surfaces 16 and 18, small fasteners, such as, for example, staples, tacks, or finishing nails or screws, may be used. The use of small fasteners is advantageous because the occurrence of marring and other damage to the front surface 60 of the backing member 24 during the installation of the crown molding 12 is greatly reduced. As a result, an installer will require less time and effort, if any, to fill, sand or otherwise repair the front surface 60 of the crown molding 12 after the final installation.

As shown in FIGS. 2, 4 and 6, the bottom wall 50 of the supporting portion 28 may be provided with one or more retaining portions 62 for releasably coupling the ends 56, 58 of the backing member 24 within the respective channels 48 of the support members 30, 32. The configuration of the retaining portions 62 is identical to that of the positioning portions 40 described in relation to the base 34 of the mounting portion 26, although the dimensions of the retaining portions 62 may be changed depending the weight of the crown molding 12 to be supported by the installation brackets 20. Each of the retaining portions 62 includes a retaining slot 64 formed in the bottom wall 50 of the supporting portion 28 and a retaining tooth 66 formed from the material separated from bottom wall 50 during the formation of the retaining slot 64. Each retaining tooth 66 has a tapered end 68 and is curved so that the tapered end 68 will be driven at least partially through the retaining slot 64 and into the front surface 60 of the backing member 24 when the first and second ends 56 and 58 of the backing member 24 are received within the corresponding channels 48 in the support members 30, 32. The tapered configuration of the tapered end 68 enables the retaining tooth 66 to be inserted or hammered into the backing member 24 to complete the installation of the installation bracket 20 against the wall and ceiling surfaces 16 and 18. It should be understood by a person skilled in the art of the present invention that an installer may use any suitable small fastener alone or in conjunction with the retaining portions 62 to secure the supporting portion 28 the backing member 24.

In an embodiment of the present invention shown in FIG. 3, the front surface 60 of the backing member 24 is formed with a plurality of segments 70 defined by spaced apart segment lines 72. As such, one or more of the segments 70 may be snapped or cut off along the desired segment lines 72 to adjustably shorten the length of the backing member 24 to conform to the dimensions of the length of crown molding 12 to be installed or to account for any misalignments of the wall and ceiling surfaces 16 and 18 (not shown). During the snapping operation, the installer may grasp and apply force to either side of the desired segment line 72 to snap off one or more segments 70 and shorten the length of the backing member 24.

The installation brackets 20 may be manufactured from any suitable material or combination of materials, such as, for example, stainless steel, aluminum, high density plastic or wood. Preferably, each of the support members 30, 32 are manufactured from a single sheet of metal punched and formed into the desired shape of the mounting portion 26 and the supporting portion 28. The backing member 24 is preferably manufactured from a wood, metal or plastic material which is dimensioned to be received within the channels 48 formed in the support members 30, 32. The backing member 24 material should also possess sufficient strength characteristics to support the weight of the crown molding 12 when fastened directly to the backing member 24 using a small fastener.

In use, one or more installation brackets 20 are used to support each length of crown molding 12 along and proximate to junction 14 of the wall and ceiling surfaces 16 and 18. The appropriate dimensions of the backing member 24 may be determined based upon the dimensions and weight of the crown molding 12 to be installed by the installer. If necessary, the length of the backing member 24 may be shortened by snapping off one or more segments 70 thereof across the corresponding segment lines 72. The first and second ends 56, 58 of the backing member 24 are then inserted into the corresponding channels 48 formed in the first and second support members 30, 32. The retaining teeth 66 of the retaining portions 62 are then driven into the first and second ends 56, 58 of the backing member 24 to prevent the backing member 24 from disengaging from each of the first and second support members 30, 32 during and following the installation of the crown molding 12.

As shown in FIG. 1, the assembled one or more installation brackets 20 are then positioned adjacent to the junction 14 of the wall and ceiling surfaces 16, 18, such that the base 34 of each of the first and second support members 30 and 32 is placed generally against and parallel to the wall and ceiling surfaces 16 and 18, respectively. To test fit the installation of the installation bracket 20, the positioning tooth 44 of the base 34 of each of the first and second support members 30 and 32 can be releasably secured to the respective wall and ceiling surfaces 16 and 18. In most crown molding installations, it will be necessary to install at least two installation, brackets 20 along the junction 14 of the wall and ceiling surfaces 16 and 18 so as to properly align and safely support the weight of the installed crown molding 12. If the crown molding 12 is not properly seated against either of the wall or ceiling surfaces 16, 18, the installer may remove the crown molding 12 to make the necessary adjustments to the positioning of the one or more installation brackets 20. As small fasteners are used to secure the crown molding 12 to the backing member 24, the occurrence of marring or other damage to the front surface 60 of the crown molding 12 is greatly reduced in the present invention. Adjustments to the positioning of the crown molding 12 may include, for example, shortening the backing member 24 and/or changing the angle of inclination of the mounting portion 26 along axis A-A in relation to the supporting portion 28.

When each of the support members 30, 32 of the one or more installation brackets 20 in the system 10 have been properly positioned by the installer, one or more fasteners 38 may be secured into the wall and ceiling surfaces 16 and 18, respectively, through the apertures 36 in the base 34. The length of crown molding 12 may then be repositioned along the one or more installation brackets 20 and secured to the underlying backing members 24 using one or more small fasteners. It will be noted that while two installation brackets 20 are shown supporting the length of crown molding 12 in the installation bracket system 10 shown in FIG. 1, any suitable number of installation brackets 20 may be used to support each length of crown molding 12, depending on the nature of the specific installation.

While what has been shown and described herein constitutes a preferred embodiment of the subject invention, it should be understood that various modifications and adaptations of such embodiment can be made without departing from the present invention, the scope of which is defined in the appended claims.

The invention claimed is:

1. An installation bracket for use in combination with a length of crown molding for securing the crown molding adjacent to the junction of a wall surface and a ceiling surface, the installation bracket comprising: a first support member and a second support member, each of the support members having a mounting portion and an integrally formed supporting portion, the mounting portion having a base formed with apertures to receive fasteners therethrough for securement of the first support member and the second support member to the wall surface and the ceiling surface, respectively; a backing member extending between the first support member and the second support member, the backing member having a front surface, the crown molding being secured against the front surface of the backing member, wherein said supporting portion is further defined as having a C-shaped channel for receiving and supporting at least a portion of said backing member, said channel having a bottom wall, a pair of opposing side walls and a pair of top flanges extending from the opposing side walls.

2. An installation bracket as claimed in claim 1, wherein each of the pair of support members comprises a single flat metal piece punched and bent to form the mounting portion and the supporting portion.

3. An installation bracket as claimed in claim 1, wherein each supporting portion extends from the mounting portion along an inclined plane.

4. An installation bracket as claimed in claim 1, the backing member having a first end and a second end, wherein the supporting portion of the first support member receives and supports the first end of the backing member, and wherein the supporting portion of the second support member receives and supports the second end of the backing member.

5. An installation bracket as claimed in claim 1, wherein the base of the mounting portion of each of the first and second support members is formed with one or more positioning portions for releasably securing the support members to the wall and ceiling surfaces, respectively, each of the positioning portions having a positioning slot and an integrally formed positioning tooth formed from the material separated from the base during the formation of the positioning slot.

6. An installation bracket as claimed in claim 5, wherein the positioning tooth is further defined as having a curved and tapered end for insertion partially through the positioning slot and into either of the wall and ceiling surfaces.

7. An installation bracket as claimed in claim 1, wherein the bottom wall of the supporting portion of each of the first and second support members is formed with one or more retaining portions for releasably securing the backing members within the channels, each of the retaining portions having a retaining slot and an integrally formed retaining tooth formed from the material separated from the bottom wall during the formation of the retaining slot.

8. An installation bracket as claimed in claim 7, wherein the retaining tooth is further defined as having a curved and tapered end for insertion partially through the retaining slot and into the backing member.

9. An installation bracket as claimed in claim 1, wherein the backing member is further defined as having a front surface and a back surface, each of the front and back surfaces formed with a plurality of segments defined by spaced apart segment lines, portions of the backing member being adaptable for snapping along the spaced apart segment lines to shorten the length of the back member.

10. An installation bracket system for use in combination with a length of crown molding for securing the crown molding adjacent to the junction of a wall surface and a ceiling surface, the installation bracket system comprising: one or more installation brackets, each of the one or more installation brackets having a first support member and a second support member; each of the support members having a mounting portion and an integrally formed supporting portion, the mounting portion having a base formed with apertures to receive fasteners therethrough for securement of the first support member and the second support member to the wall surface and ceiling surface, respectively; and a backing member extending between the first support member and the second support member, the backing member having a front surface, the crown molding being secured against the front surface of the backing member, wherein said supporting portion is further defined as having a C-shaped channel for receiving and supporting at least a portion of said backing member, said channel having a bottom wall, a pair of opposing side walls and a pair of top flanges extending from the opposing side walls.

11. An installation bracket system as claimed in claim 10, wherein each of the pair of support members comprises a single flat metal piece punched and bent to form the mounting portion and the supporting portion.

12. An installation bracket system as claimed in claim 10, wherein each supporting portion extends from the mounting portion along an inclined plane.

13. An installation bracket system as claimed in claim 10, the backing member having a first end and a second end, wherein the supporting portion of the first support member receives and supports the first end of the backing member, and wherein the supporting portion of the second support member receives and supports the second end of the backing member.

14. An installation bracket system as claimed in claim 10, wherein the base of the mounting portion of each of the first and second support members is formed with one or more positioning portions for releasably securing the support members to the wall and ceiling surfaces, respectively, each of the positioning portions having a positioning slot and an integrally formed positioning tooth formed from the material separated from the base during the formation of the positioning slot.

15. An installation bracket as claimed in claim 14, wherein the positioning tooth is further defined as having a curved and tapered end for insertion partially through the positioning slot and into either of the wall and ceiling surfaces.

16. An installation bracket as claimed in claim 10, wherein the bottom wall of the supporting portion of each of the first and second support members is formed with one or more retaining portions for releasably securing the backing members within the channels, each of the retaining portions having a retaining slot and an integrally formed retaining tooth formed from the material separated from the bottom wall during the formation of the retaining slot.

17. An installation bracket as claimed in claim 16, wherein the retaining tooth is further defined as having a curved and tapered end for insertion partially through the retaining slot and into the backing member.

18. An installation bracket as claimed in claim 10, wherein the backing member is further defined as having a front surface and a back surface, each of the front and back surfaces formed, with a plurality of segments defined by spaced apart segment lines, portions of the backing member being adaptable for snapping along the spaced apart segment lines to shorten the length of the back member.

* * * * *